US006899836B2

(12) United States Patent
Samant et al.

(10) Patent No.: US 6,899,836 B2
(45) Date of Patent: May 31, 2005

(54) PROCESS OF MAKING POLYAMIDE FILAMENTS

(75) Inventors: K Ranjan Samant, Hockessin, DE (US); George Vassilatos, Wilmington, DE (US)

(73) Assignee: Invista North America S.a r.l., Wilmington, DE (US)

( * ) Notice: Subject to any disclaimer, the term of this patent is extended or adjusted under 35 U.S.C. 154(b) by 292 days.

(21) Appl. No.: 10/155,159

(22) Filed: May 24, 2002

(65) Prior Publication Data

US 2003/0219595 A1 Nov. 27, 2003

(51) Int. Cl.[7] ..... D01D 5/16; D01F 1/04; D01F 1/10; D01F 6/60; D02G 3/02

(52) U.S. Cl. ..... 264/78; 264/103; 264/210.6; 264/210.8; 264/211.12; 264/211.14

(58) Field of Search ..... 264/78, 103, 210.6, 264/210.8, 211.12, 211.14

(56) References Cited

U.S. PATENT DOCUMENTS

| | | | |
|---|---|---|---|
| 4,195,052 A | 3/1980 | Davis et al. | |
| 4,687,610 A | 8/1987 | Vassilatos | |
| 4,691,003 A | 9/1987 | Sze | |
| 4,880,961 A | 11/1989 | Duncan | |
| 5,034,182 A | 7/1991 | Sze et al. | |
| 5,141,700 A | 8/1992 | Sze | |
| 5,824,248 A | 10/1998 | Sweet et al. | |
| 5,976,431 A | 11/1999 | Mears | |
| 2002/0037411 A1 * | 3/2002 | Frankfort et al. | 264/210.6 X |

FOREIGN PATENT DOCUMENTS

| | | |
|---|---|---|
| DE | 19514866 A1 | 11/1995 |
| EP | 0244217 A2 | 11/1987 |
| EP | 0682720 B1 | 6/1995 |
| FR | 2494729 A | 5/1982 |
| WO | WO 01/48279 A2 | 7/2001 |

OTHER PUBLICATIONS

Treptow, H., Loy–Moy–Poy–Hoy–Foy?. Man–Made Fiber Year Book (CTI), 1986, p. 6.

* cited by examiner

*Primary Examiner*—Leo B. Tentoni

(57) ABSTRACT

The present invention relates to methods for making polyamide filaments, such as nylon 6,6, having high tensile strength. The invention also relates to yarns and other articles formed from such filaments. The invention is particularly useful for providing a filament yarn with tenacity equal or superior to the prior art at high spinning process speeds while retaining the ability to draw the yarn. The invention further relates to providing a filament yarn extruded from a delustered or pigmented polyamide polymer.

15 Claims, 7 Drawing Sheets

PROCESS OF MAKING POLYAMIDE FILAMENTS

BACKGROUND OF THE INVENTION

1. Field of the Invention

The present invention relates to methods and apparatus for making polyamide filaments, such as nylon 6,6, having high tensile strength at high spinning speeds. The invention also relates to yarns and other articles formed from such filaments.

2. Related Prior Art

Many synthetic polymeric filaments, such as polyamides, are melt-spun, i.e., they are extruded from a heated polymeric melt. Melt-spun polymeric filaments are produced by extruding a molten polymer through a spinneret with a plurality of capillaries. The filaments exit the spinneret and are then cooled in a quench zone. The details of the quenching and subsequent solidification of the molten polymer can have a significant effect on the quality of the spun filaments.

Methods of quenching include cross-flow, radial, and pneumatic quench. Cross-flow quenching is frequently used for producing high strength polyamide fibers and involves blowing cooling gas transversely across and from one side of the freshly extruded filamentary array. In cross-flow quenching, airflow is generally directed at a right angle to the direction of movement of the freshly extruded filaments.

In radial quench, the cooling gas is directed inwards through a quench screen system that surrounds the freshly extruded filamentary array. Such cooling gas normally leaves the quenching system by passing down with the filaments and out of the quenching apparatus.

Both cross-flow quench and radial quench are limited to fiber production at relatively low speed, about 2,800–3,000 meters per minute, for high tenacity application. Higher production speeds increase the number of broken filaments during the draw stages. Broken filaments interrupt the process continuity and decrease the product yield.

In the 1980's, Vassilatos and Sze made significant improvements in the high-speed spinning of polymeric filaments, especially polyester filaments. These improvements are disclosed in U.S. Pat. Nos. 4,687,610, 4,691,003, and 5,034,182.

These patents disclose gas management techniques, whereby gas surrounds freshly extruded filaments to control their temperature and attenuation profiles. These types of quench systems and methods are known as pneumatic quench or pneumatic spinning systems. Other pneumatic quenching methods include those described in U.S. Pat. No. 5,976,431 and U.S. Pat. No. 5,824,248.

The pneumatic quench spinning process provides an advantage of reduced filament and, subsequently, reduced yarn tension during spinning. In general this reduced yarn tension provides better productivity via higher spinning speeds with reduced filament breaks and a processability advantage for the wound yarn. Generally, pneumatic quenching involves supplying a given volume of cooling gas to cool a polymeric filament. Any gas may be used as a cooling medium. The cooling gas is preferably air, because air is readily available. Other gases may be used, for instance steam or an inert gas, such as nitrogen, if required because of the sensitive nature of the polymeric filaments, especially when hot and freshly extruded.

In pneumatic spinning, the cooling gas and filaments travel substantially co-linearly in the same direction through a conduit wherein the speed is controlled by the speed of a roll assembly means. The tension and temperature are controlled by the gas flow rate, the diameter or cross-section of the conduit (which controls the gas velocity), and the length of the conduit. The gas may be introduced at one or more locations along the conduit. Pneumatic spinning allows for spinning speeds in excess of 5,000 meters per minute.

Tenacity is a key fiber property for industrial fibers. Tenacity is obtained by drawing quenched fibers in stages. This drawing in stages works well with cross flow at currently commercially available low speeds. An example of a known cross-flow quench and coupled spin-draw apparatus is shown in FIG. 1. In this apparatus, a melted polyamide is introduced at 10 to a spin pack 20. The polymer is extruded as undrawn filaments 30 from the spin pack, which has orifices designed to give the desired cross section. The filaments are quenched after they exit the capillary of the spin pack to cool the fibers by cross-flow cooling air at 40 in FIG. 1. These filaments are converged into a yarn 60 with application of a conventional finish lubricant at 50 and forwarded by a feed roll assembly 70. The yarn is then fed to a first draw roll pair 80 and then to a second draw roll pair 100. A hot tube 90, or draw assist, may be used to facilitate the second stage of the draw process. The yarn is relaxed at puller rolls 110 and 120. Roll 110 is also known as a relaxation roll; it can run at lower speeds than draw roll assembly 100 to control yarn shrinkage. Roll 120 is also known as a let-down roll relaxes the yarn tension to allow winding on at a lower tension than the yarn experiences in drawing. A guide 130 lays down the yarn on a yarn package 140, where it is wound up.

A known melt extrusion and coupled multi-stage drawing assembly using a cross-flow quench system is shown in FIG. 2. The assembly of FIG. 2 is similar to that of FIG. 1, but does not include a hot tube as FIG. 1 does, since the hot tube may damage the fiber. In FIG. 2, the draw is accomplished through rolls instead of a hot tube. In this apparatus, a melted polyamide is introduced at 200 to a spin pack 210. The polymer is extruded as undrawn filaments 220 from the spin pack, which has orifices designed to give the desired cross section. The filaments are quenched after they exit the capillary of the spin pack to cool the fibers by cross-flow cooling air at 230 in FIG. 2. These filaments are converged into a yarn bundle as shown at 250 with application of a conventional finish lubricant at 240 and forwarded by a feed roll assembly 260. The yarn is then fed to a first stage draw roll pair 270, and then to a second draw roll pair 275. An optional third draw roll assembly 280 may be used to further draw the fiber. The yarn is relaxed at relaxation roll 285. A guide 290 lays down the yarn on a yarn package 295 which is rotated by a winder chuck and wound up.

It is not possible to achieve higher spinning speeds in the cross-flow quench systems of FIGS. 1 and 2 through the use of cross-flow quench so as to increase productivity. The ability to draw a yarn decreases significantly with the use of cross-flow, which reduces ultimate yarn tenacity. Moreover, it is important that the produced polyamide yarn has properties at least as good as those obtainable at slower speeds. In particular, it is desirable to maintain the desired tenacity, elongation-to-break and uniformity of the produced yarn. Thus, there is a need in the art to provide methods and apparatus for high speed spinning of yarn while maintaining these properties.

Difficulties in the use of high spinning speeds are especially evident in colored or delustered nylon yarns. Such yarns are extruded from nylon polymers containing pigments, which provide a color palette of wide variety.

Nylon yarn polymers are often delustered by the addition of titanium dioxide or zinc sulfide. Typically, the delustered and/or pigmented nylon cause problems for melt extrusion, partly due to differences in the melt flow behavior, microstructure development and heat loss properties compared to un-pigmented or non-delustered nylon. The presence of an increased level of filament breaks when using delustered or pigmented polymers is a long-standing problem. It is known that an attempt to increase extrusion speeds exacerbates the broken filament problem. Thus, it would be desirable in particular to provide a high speed spinning process that produces pigmented polyamide yarn without experiencing filament breaks.

SUMMARY OF THE INVENTION

In the present invention, high tenacity yarns are prepared at a spinning speed (defined as the surface speed of the highest speed draw roll) in range of about 2500 meters per minute to about greater than 5000 meters per minute with commercially desirable levels of elongation-to-break and shrinkage. By contrast, yarns produced via prior art methods employing conventional cross flow quench are fraught with loss of tenacity and elongation as spinning speed increases. Shrinkage of fibers produced via these conventional methods is also undesirably high. A good balance of these properties is required in order to meet requirements of technical polyamide fibers used in such applications as automotive air bags, cured-in rubber reinforcement yarns (e.g., tire yarns), protective apparel, soft luggage. Further, low strength coupled with low elongation-to-break and high shrinkage typically imply a process that is not robust and of commercial quality.

Thus, it is also an object of the present invention to provide increased filament extrusion speeds with a concomitant improvement in productivity and yarn properties of high strength nylon yarns and high strength nylon yarns containing pigments.

It is a further object of the present invention to provide a high speed spinning and coupled drawing process that gives polyamide (optionally pigmented) filaments, yarns, and articles of desired characteristics, for example, at least having the properties at least equivalent to those obtained in products prepared in conventional speed cross-flow quenched processes. It is yet a further object to provide yarns and articles having improved tenacity.

In accordance with the objectives, the present invention provides a process for producing a polyamide yarn, comprising: extruding a polymeric melt through a spin pack to form at least one filament; passing the filament to a pneumatic quench chamber where a quench gas is provided to the filament to cool and solidify the filament, wherein the quench gas is directed to travel in the same direction as the direction of the filament; passing the filament to a mechanical drawing stage and drawing and thereby lengthening the filament to form a yarn. If the yarn is a multi-filament yarn, the at least one filament comprises a plurality of filaments, the plurality of filaments are converged into a multifilament yarn, and the yarn is passed to a mechanical drawing stage, where it is drawn and thereby lengthened. If the yarn is a monofilament yarn, then at least one filament comprises a single filament per yarn.

Further objects, features and advantages of the invention will become apparent from the detailed description that follows.

DETAILED DESCRIPTION OF THE INVENTION

Figure 1:
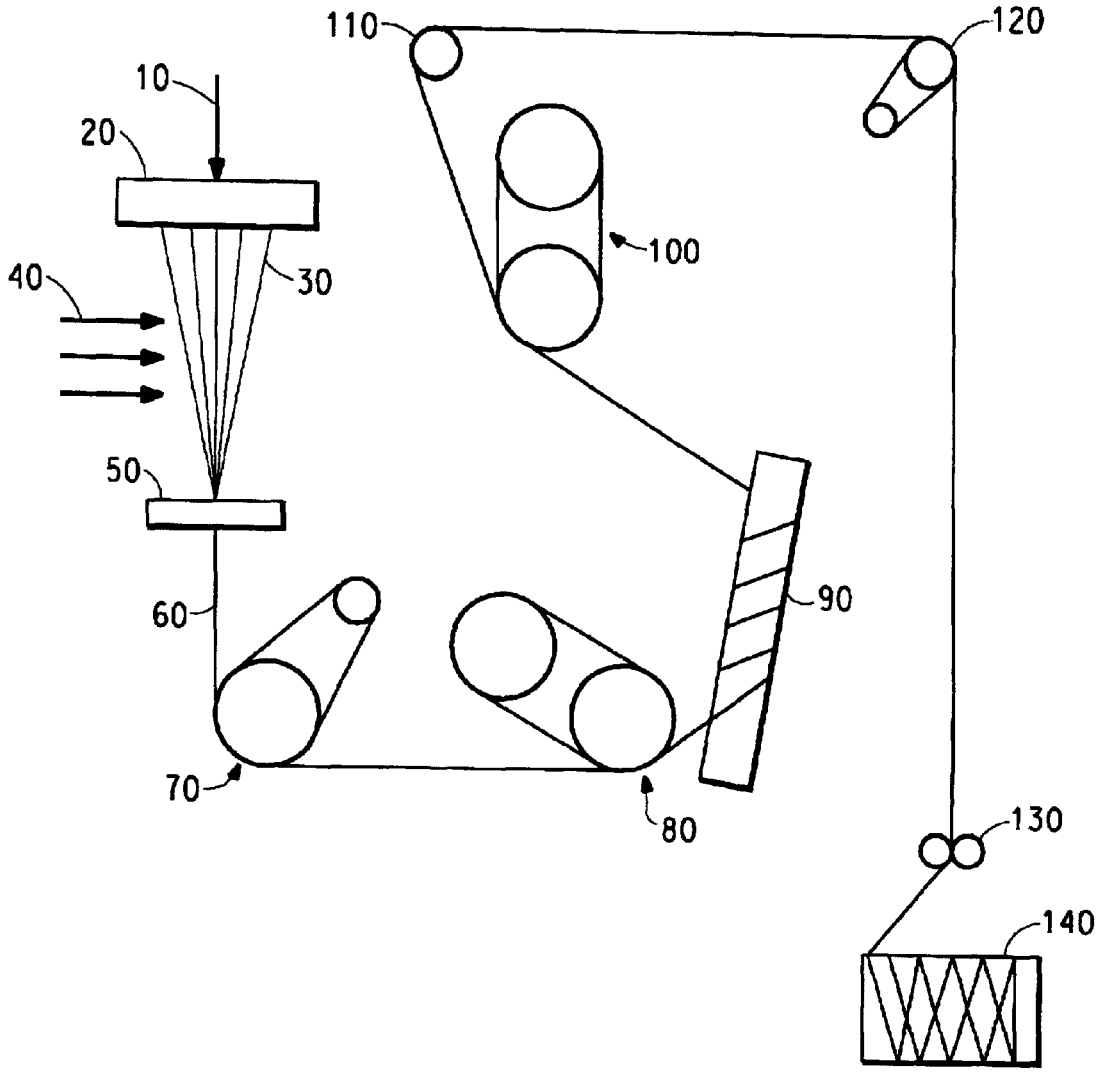
FIG. 1 (PRIOR ART)
FIG. 1 is a schematic cross-sectional view of a prior art filament quenching and coupled spin-draw apparatus which uses a hot tube for drawing.

In accordance with the present invention, there is provided a process for producing a mono- and multi-filament polyamide yarns. Generally, monofilament yarns consist of a single filament per yarn whereas multi-filament yarns consist of a plurality of monofilaments. The term "filament" is used herein generically, and encompasses also short discontinuous fibers known as staple in the art. Polyamide filaments formed by melt spinning, extrusion through a die or spinneret capillary, are initially prepared in the form of continuous filaments. The filaments so produced have any desired cross-sectional shape as determined by the cross sectional shape of the capillary and may include circular, oval, trilobed, multilobed, ribbon and dog bone.

Any melt-spinnable polyamide can be used to make the filament of the present invention. The polyamides can be a homopolymer, copolymer, or terpolymer, or mixtures of polymers. Exemplary polyamides include polyhexamethylene adipamide (nylon 6,6); polycaproamide (nylon 6); polyenanthamide (nylon 7); nylon 10; polydodecanolactam (nylon 12); polytetramethyleneadipamide (nylon 4,6); polyhexamethylene sebacamide homopolymer (nylon 6,10); a polyamide of n-dodecanedioic acid and hexamethylenediamine homopolymer (nylon 6,12); and a polyamide of dodecamethylenediamine and n-dodecanedioic acid (nylon 12,12). Methods of making the polyamides used in the present invention are known in the art and may include the use of catalysts, co-catalysts, and chain-branchers to form the polymers, as known in the art. Preferably, the polymer is nylon 6, nylon 6,6, or a combination thereof. Most preferably, the polyamide is nylon 6,6.

In the process of the invention, a polymeric melt is extruded through a spin pack to form at least one filament. The spin pack may include a spinneret plate drilled with one, two or a plurality of holes (capillaries) using known techniques to form at least one filament. In the monofilament embodiment, a single or mono-filament forms the monofilament yarn, and in the multi-filament embodiment, a plurality of mono-filaments form the multi-filament yarn.

Figure 3:
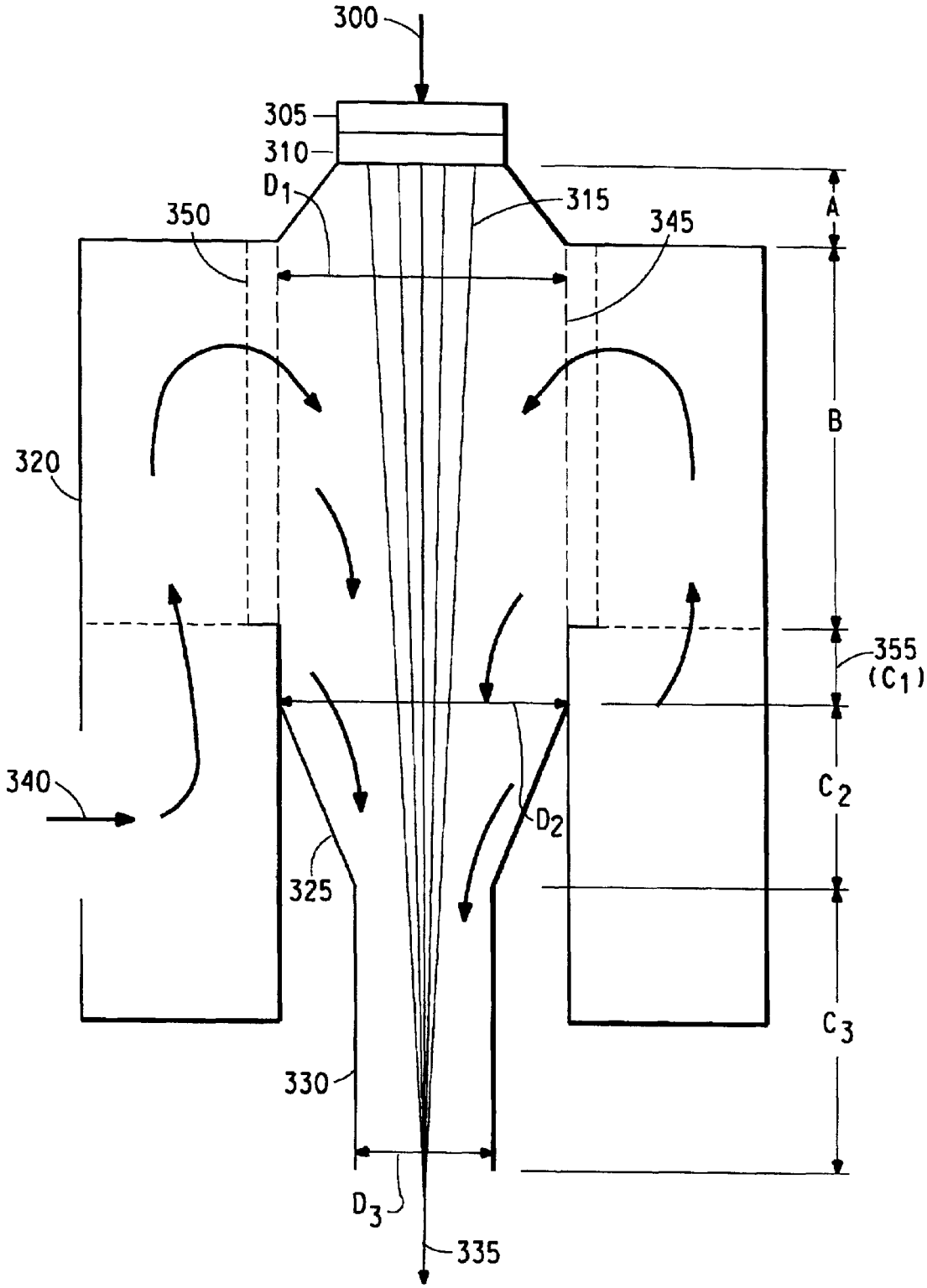
FIG. 3 is a schematic cross-sectional view of a pneumatic filament quenching apparatus according to the present invention.

Examples of suitable pneumatic spinning methods and systems, which may be used, are disclosed in U.S. Pat. No. 5,824,248 and U.S. Ser. No. 09/547,854 filed Apr. 12, 2000. Any of the pneumatic methods described above can also be used. A preferred pneumatic filament quenching system for use in the present invention is shown schematically in FIG. 3. The assembly of FIG. 3 can be used as the quench chamber of FIG. 4 or 5. In FIG. 3, a polymeric melt 300 is extruded through a filament spinning pack 305 and a spinneret plate 310, having at least one, and preferably multiple capillaries to form at least one, and preferably a plurality, of filaments 315. The at least one filament is passed to a pneumatic quench chamber 320, which is part of a pneumatic quench assembly. The pneumatic quench assembly includes a heated or unheated quench delay section of height A; a quench screen section 345 of height B and diameter $D_1$; a quench connecting tube 355 of height $C_1$ and diameter $D_2$; a connecting taper 325 of height $C_2$; and a quench tube 330 of height $C_3$ and diameter $D_3$. In the pneumatic chamber, a quench gas is provided at 340 to cool and solidify the filament. Preferably, the filament passes through the quench chamber at a speed of less than 1500 m/min. Quench screen 345 surrounds the filaments in the quench chamber, and a perforated quench screen 350 may optionally be placed next to the quench screen in the quench chamber. The filaments and the quench gas exit the quench chamber via quench tube 330. The freshly quenched yarn is shown at 335.

For a given polymerization condition, filament size and throughput, the distance between the spinneret plate and the connecting taper determines the location along the filaments where gas accelerates and provides the pneumatic quench affect. The quench gas is directed to travel in the same direction as the direction of the filaments, as indicated by the arrows in FIG. 3. The quench gas speed is controlled with respect to the filament speed which in turn minimizes the quench gas aerodynamic drag forces on the filaments. These forces normally act more significantly at higher spinning speeds to attenuate the filament and impart undesirable early orientation to the freshly spun filaments. Filament orientation in the quench portion of the spin process is undesirable since this orientation limits the ultimate mechanical drawing of the filaments available. The reduced aerodynamic drag experienced by the filament in a pneumatically quenched spinning process have a lower orientation as measured by the birefringence of the filament.

Figure 4:
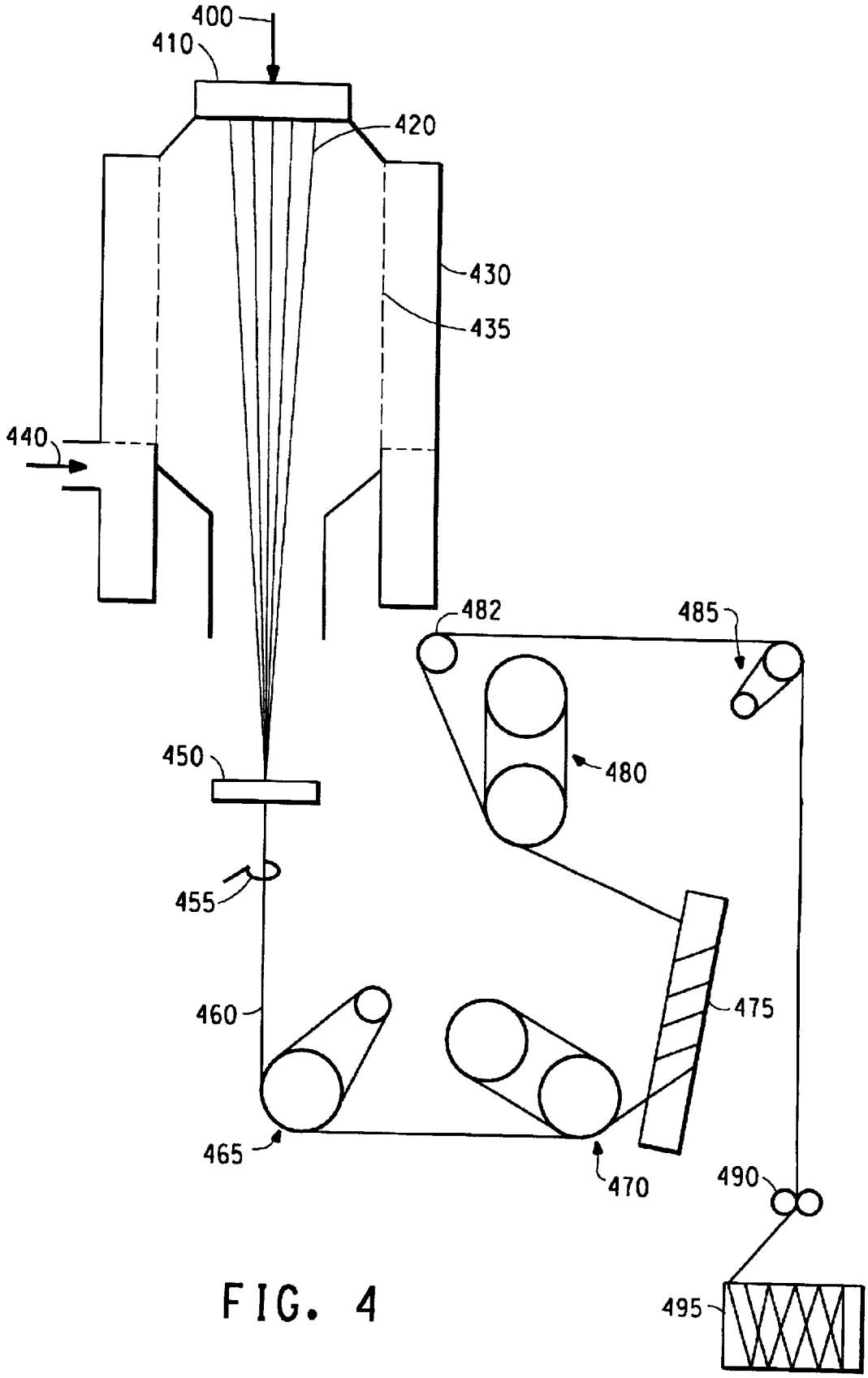
FIG. 4 is a schematic cross-sectional view of a pneumatic filament quenching and coupled spin-draw apparatus according to a different embodiment of the present invention.
Figure 5:
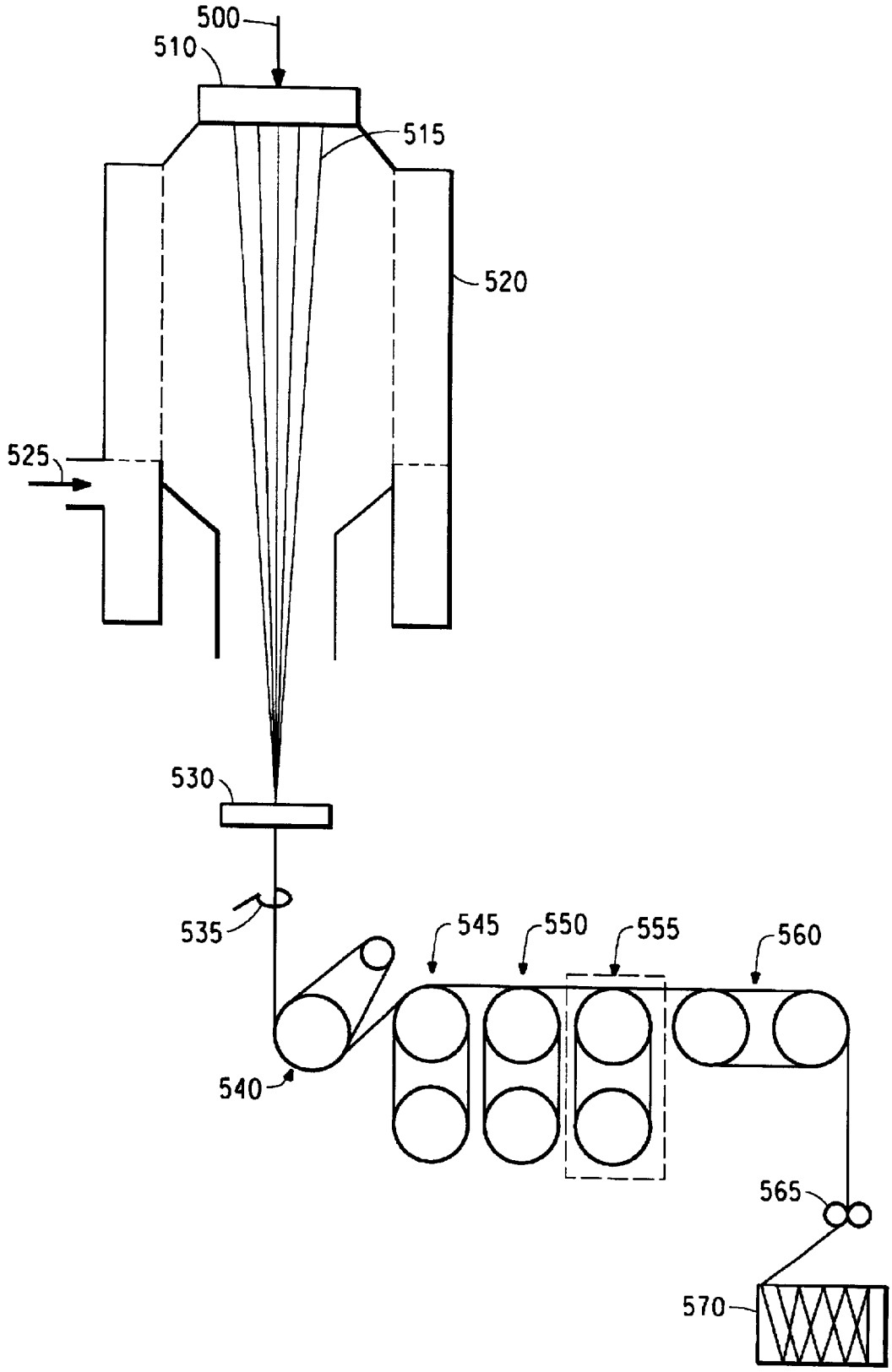
FIG. 5 is a schematic cross-sectional view of a pneumatic filament quenching and coupled spin-draw apparatus according to another embodiment of the present invention.

The formation of a polyamide yarn from the filaments produced according to the process of the present invention is illustrated with respect to FIGS. 4 and 5. As shown in FIG. 4, a polymeric melt 400 is extruded through a spinning pack 410 to form at least one, and preferably a plurality of filaments 420. The spinning pack 410 contains a filter media and a multi-capillary spinneret plate. The freshly extruded filaments 420 are quenched in a pneumatic quench chamber 430, which is of the type shown in FIG. 3, by the introduction of quench air 440 to the quench chamber 430. A quench screen 435 surrounds the filaments in FIG. 4.

In the multifilament yarn embodiment, the process of the present invention further includes the step of converging the solidified filaments into a multi-filament yarn. The filaments 420, exiting the quench chamber 430, are converged into a yarn 460 by a pig tail guide 455 located downstream of a filament finish application roll 450. The finish roll 450 is used to apply oil or other types of finish known in the art.

The process of the present invention further includes the step of passing the filament, or in the case of the multi-filament yarn embodiment, passing the yarn, to a mechanical drawing stage and drawing and thereby lengthening the filament or the yarn. The filament is drawn in at least one, and usually multiple, drawing stages. This step is accomplished in the embodiment of FIG. 4 by a first draw roll pair 470 and a second draw roll pair 480. A feed roll assembly 465 forwards the treated yarn 460 to first draw roll pair 470 which is heated and operated at a speed higher than the feed roll 465 such that the yarn is drawn in space between rolls 465 and 470. Second heated draw roll pair 480, running at a surface speed higher than the roll 470, further draws the yarn over a heated draw pin assembly, or hot tube, 475, as disclosed in U.S. Pat. No. 4,880,961. Preferably, the filament or the yarn passes through the final drawing stage at a speed of greater than about 2600 m/min, and even more preferably at a speed of greater than about 4500 m/min. The draw ratio, defined as the ratio of roll surface speeds (highest speed roll/lowest speed roll), provides polymer chain alignment (orientation) necessary for achieving high yarn strength or tenacity. Preferably, the filament or the yarn is drawn at a draw ratio of about 3 to about 6. Heat from the heated roll surfaces 470, 480 and draw pin assembly 475 stabilize the drawn (oriented) structure of the multi-filament yarn. The yarn is relaxed between draw roll 480 and rolls 482 and 485 to control final yarn shrinkage.

The process of the present invention may further comprise the step of winding the filament or the yarn into a package. In the embodiment of FIG. 4, fully drawn yarn with the desired tenacity, shrinkage and other properties is wound on to a package 495 rotated by the chuck of a winder not shown in FIG. 4. Guide 490 is used to control yarn path. Although not shown, a broken threadline detector is often used at this location to stop the winder should a threadline break occur. Optionally, a broken filament detector is mounted between rolls 482 and 485 to signal the presence of an undesirable level of filament breaks. If desired, a secondary finish oil can be further applied prior to winding.

In accordance with the present invention, the drawing may comprise drawing the filaments in two or more stages. This embodiment is illustrated with respect to FIG. 5. As shown in FIG. 5, a polymeric melt 500 is extruded through a spinning pack 510 to form at least one, and preferably a plurality of filaments 515. The spinning pack 510 comprises a filter media and a multi-capillary spinneret plate. The freshly extruded filaments 515 are passed to a pneumatic quench chamber 520, e.g., as in FIG. 3. The freshly extruded filaments 515 are quenched in a pneumatic quench chamber 520, which is of the type for shown in FIG. 3, by the introduction of quench air 525 to the quench chamber 520. The filaments 515 exiting the quench chamber 520 are converged into a multi-filament yarn by the guide 535 located downstream of finish roll 530. The finish roll 530 is used to apply filament finish oil, of a known type to the multi-filament yarn. A feed roll assembly 540 forwards the treated multi-filament yarn to a first draw roll pair 545 which is heated and operated at a speed higher than the feed roll 540 such that the multi-filament yarn is drawn in space between rolls 540 and 545. A second heated draw roll pair 550, running at a surface speed higher than the roll 545, further draws the yarn in order to sufficiently orient the polymer molecules and impart strength to the yarn once the structure is stabilized over the heated surfaces of the draw rolls. An optional third draw roll pair 555 may further draw the multi-filament yarn to further increase tenacity. This yarn is relaxed in speed between draw roll 555 and rolls 560 to control final yarn shrinkage. Often a broken filament detector, mounted between rolls 555 and 560, is used to determine the product quality. Fully drawn yarn with desired tenacity, shrinkage and other properties is wound on to a package 570. A guide 565 is used to control yarn path. Although not shown, a broken threadline detector is often used at this location to stop the winder should a threadline break occur. If desired, a secondary finish oil can be further applied prior to winding.

In the monofilament embodiment, there is no step of converging the filaments as described above into a multi-filament yarn. Instead, the filament, in the form of a monofilament, is passed directly to a coupled mechanical drawing stage such as that illustrated by either FIG. 4 or 5. As a result, the monofilament is drawn and thereby lengthened and oriented. The monofilament is then wound into a package, such as that illustrated by either FIG. 4 or 5.

The filaments made in accordance with the present invention can be spun, for example, at speeds greater than 2,000 meters per minute, preferably greater than about 3,000 meters per minute, more preferably greater than about 4,000 meters per minute, most preferably greater than about 5,000 meters per minute, up to about 10,000 meters per minute. In this context, spinning speed is defined as the surface speed of the fastest moving draw roll over which the yarn is in contact prior to the yarn being wound up. At a spinning speed of about 2660 to about 5000 meters per minute, the ratio of the velocity of the cooling gas at the exit of the quench chamber to a first roll pulling the filaments is about 0.6 to about 2.0. This first roll pulling the filaments is the feed roll, i.e., roll set 465 in FIG. 4 or roll set 540 in FIG. 5. Preferably, winding the yarn is accomplished at a winding speed reduced from a spinning speed by an amount of 0.1 per cent to about 7 percent of the spinning speed.

Figure 6:
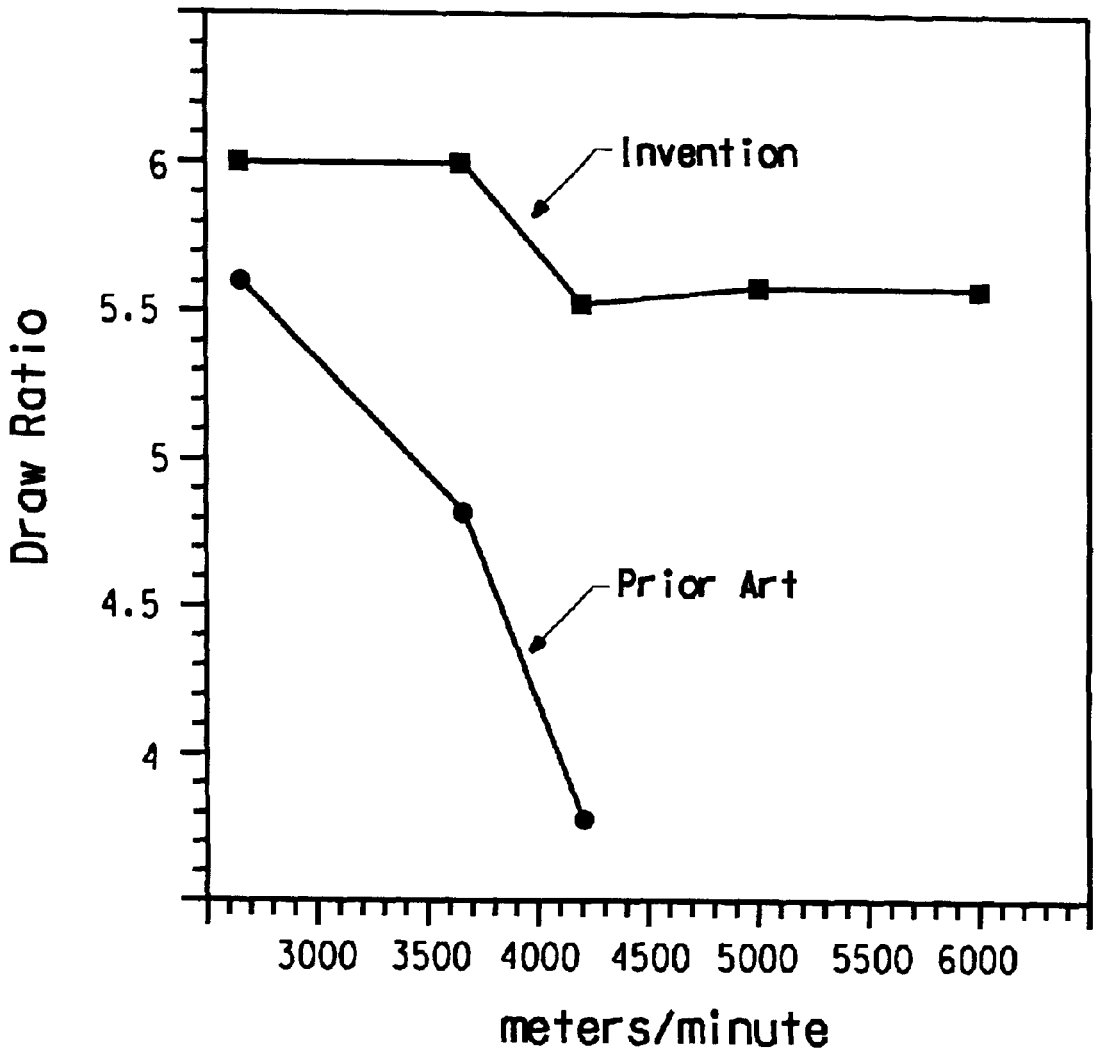
FIG. 6 is a graph comparing the maximum achievable draw ratio for the present invention and the prior art as a function of spinning speed.
Figure 7:
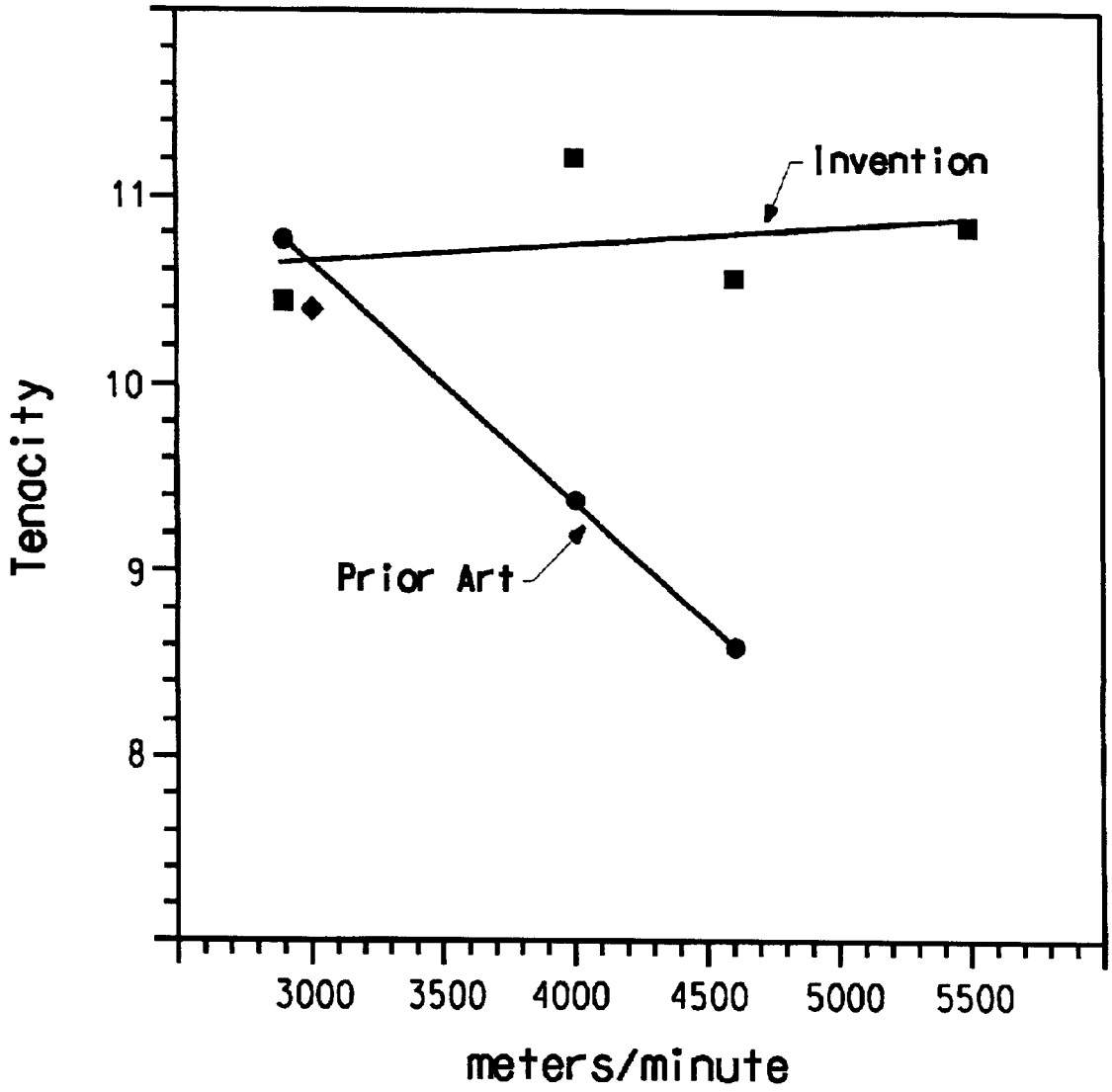
FIG. 7 is a graph comparing the measured tenacity for filaments spun according to the present invention and the prior art as a function of spinning speed.

In the present invention, high tenacity yarns are prepared at high spinning speeds with commercially desirable levels of elongation-to-break and shrinkage. By contrast, yarns produced via prior art methods employing conventional cross flow quench are fraught with loss of tenacity and elongation as spinning speed increases. Shrinkage of fibers produced via these conventional methods is also undesirably high. This is illustrated with respect to FIG. 6, which shows that the maximum achievable draw ratio of the prior art process falls off. This is due to a high number of filament breaks, which makes the process unmanageable. This also results in the tenacity falling off, as illustrated with respect to FIG. 7. Yarn tenacity is a product of it being highly drawn. As a result, the maximum tenacity achieved in the prior art falls off and becomes unmanageable at a low spinning speed (around 4000 meters per minute). FIG. 7 shows that a yarn of ca. 10.8 gram per denier is obtained by spinning with the invention quench means at 5500 meters per minute, whereas, with prior art quench means this same yarn of ca. 10.8 gram per denier is obtained at only 3000 meters per minute. The process of the invention, in this example, is (5500/3000)=1.8 times more productive than the prior art. The data of FIGS. 6 and 7 was generated using the prior art shown in FIG. 1 without the hot tube 90. Instead, yarn went from roll 80 to 100 without going over 90 which was physically not there. The rest of the yarn path was as in FIG. 1.

Thus, over a spinning speed range of about 2600 meters per minute to over 5000 meters per minute, fully drawn yarns of the present invention can have a tenacity of at least 5 grams per denier (4.5 cN per decitex), preferably greater than about 5.7 grams per denier (5.0 cN per decitex), more preferably greater than about 7.9 grams per denier (7.0 cN per decitex), more preferably greater than about 11.3 grams per denier (10 cN per decitex).

Additionally, the yarns of present invention have a desirable balance of properties, e.g., elongation at break (15 to 22%) and hot air shrinkage (less than 10%, and preferably less than 6%). Also, the yarns of the present invention have a denier spread of less than 3.7%. By contrast, yarns produced via prior art methods employing conventional cross flow quench have been fraught with loss of tenacity and elongation where increases in spinning speed are sought. Shrinkage of fibers produced via these conventional methods is also undesirably high. A good balance of these properties is required in order to meet requirements of technical polyamide fibers used in such applications as automotive air bags, cured-in rubber reinforcement yarns (e.g., tire yarns), protective apparel, soft luggage. Further, low strength coupled with low elongation-to-break and high shrinkage typically imply a process that is not robust and of commercial quality.

In addition, the filaments of the present invention can have any desired decitex per filament (dtex/fil), e.g., from 0.1 to about 20 dtex/fil. The filaments for use in industrial applications, such as air bags and sewing thread, typically are between about 2.5 to about 9 dtex/fil. For apparel uses, dtex/fil ranges, typically between 0.1 to 4 and for other applications (e.g., carpets) a higher dtex/fil, for example, about 5 to about 18, is often useful.

Prior to any mechanical drawing the filaments of the invention have a birefringence between 0.002 and 0.012. As is known to those skilled in the art, the filament birefringence indicates the relative degree of orientation of the polymer chains in the filament. This range in birefringence achieved at the feed roll assembly, with the pneumatic quench means of the invention, is indicative of a lower molecular orientation than that achieved using cross flow quenching means of the prior art. Such a low orientation at the feed roll assembly allows a much higher draw ratio to be used without encountering excessive broken filaments.

The filaments of this invention are preferably polyamide formed into multi-filament yarns, fabrics, staple fibers, molded fabric articles, continuous filament tows, and continuous filament yarns. The fabrics containing the filaments of this invention, including industrial fabrics used in sails and parachutes, carpets, garments, airbags or other articles containing at least a portion of polyamide. When fabrics are made, any known suitable method of making fabrics may be used. For example, weaving, warp knitting, circular knitting, hosiery knitting, and laying a staple product into a non-woven fabric are suitable for making fabrics.

The polyamide filament yarns of this invention can be used alone or mixed in any desired amount, typically post spinning and drawing, with other polymer synthetic fibers such as spandex, polyester, and natural fibers like cotton, silk, wool or other typical companion fibers to nylon.

The yarn made according to the process of the present invention may have any desired filament count and total decitex. The yarn formed from the filaments of the present invention typically has a total decitex between about 10 decitex and about 990 decitex denier, preferably, between about 16 decitex and about 460 decitex. Moreover, the yarn of the present invention may further be formed from a plurality of different filaments having different [dtex/fil] decitex per filament ranges, cross-sections, and/or other features.

The polymeric melt used with the process of the present invention and resultant filaments, yarns, and articles can include conventional additives, which are added during the polymerization process or to the formed polymer or article, and may contribute towards improving the polymer or fiber properties. Examples of these additives include antistatics, antioxidants, antimicrobials, flameproofing agents, colored pigments, light stabilizers, polymerization catalysts and auxiliaries, adhesion promoters, delustering particles, such as titanium dioxide, matting agents, organic phosphates, and combinations thereof. Especially preferred additives in the polymeric melt of the present invention are delustering particles such as titanium dioxide or zinc sulfide and colored pigment particles. Preferably, the polymeric melt contains about 0.01 to about 1.2 percent by weight of the colored or delustering particles.

Other additives that may be applied on the fibers during the spinning and/or drawing processes include antistatics, slickening agents, adhesion promoters, antioxidants, antimicrobials, flameproofing agents, lubricants, and combinations thereof. Such additional additives may be added during various steps of the process as is known in the art.

The invention is further illustrated by the following non-limiting examples.

Test Methods

The properties used to characterize the filaments of the present invention were measured in the following ways:

Tenacity is measured on an Instron tensile testing machine (ASTM D76) equipped with two grips, which hold the yarns at the gauge lengths of 10 inches (25.4 cm). Sample is subjected to 3 twists/inch (1.2 twists/cm) and the yarn is then pulled by the at a strain rate of 10 inches/minute (25.4 cm/minute). A load cell records the data, and stress-strain curves are obtained. Tenacity is the breaking force divided by the yarn denier, expressed in grams/denier or cN/dtex (cN/dtex=grams/denier×(100/102) ×(9/10). Elongation at break, expressed in per cent, is the change in sample length at break divided by its original length. Instron measurements are made at 21° C. (+/−1° C.) and 65% relative humidity. Denier is the linear density of the sample obtained by measuring weight, in grams, of 9000 m length (decitex is the denier multiplied by the factor 10/9). The tenacity and elongation measurement methods generally conform to ASTM D 2256.

The uniformity of yarn linear density (expressed by denier or decitex) is determined by repetitively weighing a specified length of the yarn and comparing a representative number of samples. The linear density of a yarn is measured by the "cut and weigh" method known to those skilled in the art. In this method a specified length (L) of yarn, e.g. 30 meters of yarn, is cut from a yarn package and weighed. The weight (W) of the yarn sample is expressed in grams. The weight to length ratio (W/L) is multiplied by 9000 meters of yarn to express denier. Alternatively, W/L is multiplied by 10,000 meters of yarn to express decitex. The process of cutting and weighing is typically repeated 8 times. The average of 8 measurements from a single yarn package is called the "along end" denier uniformity. An automated test apparatus ACW400/DVA is available from LENZING TECHNIK, GmbH & Co. KG, Austria for making this measurement. The ACW400/DVA instrument is a fully automated measuring system for denier/dtex and uniformity of filament yarns according to the cut and weigh method. The LENZING TECHNIK ACW400/DVA instrument includes a denier variation accessory (DVA) which provides an automated measure of denier variation referred to in the art as the "denier spread". The denier spread measurements herein are all performed according to the methods provided by LENZING TECHNIK for the denier variation accessory module to the ACW400.

Standard methods according to ASTM D 789 were used for the determination of polymer relative viscosity (RV) in formic acid solution, melting point, and moisture content.

ASTM Test Method D5104-96 is the standard method for filament shrinkage (Single-Fiber Test), as used herein.

The birefringence of individual filaments was determined using polarized light microscopy and the tilting compensator technique. The following formula Eq. 1. defines birefringence:

$$\text{Birefringence} = \text{Retardation (wavelengths in nm)}/\text{sample thickness (nm)} \qquad \text{Eq. 1}$$

The thickness of the fiber is measured using a Watson Image Sheering Eyepiece and microscope. The image of the fiber measured is sheered from one side to the other and calibrated to give the thickness measurement. The retardation is measured by cutting a 45 degree wedge at one end of the fiber. The orders of interference or the retardation bands are counted as they propagate from the thinnest end of the wedge to the thickest part of the wedge or the center of the fiber. The measurement is made in crossed polarizers using a ¼ wave plate (¼ of 546 nanometer wavelength) inserted in the path of light with the fiber aligned perpendicular to the retardation direction of the ¼ wave plate. As each retardation band is counted, the portion of the band displayed in the center of the fiber must be compensated using the analyzer. The analyzer is rotated until the center band compensates and the angle is recorded. The angle (less than 180° ) represents a portion of a retardation band (at 546 nanometers). The total number of retardation bands and the portion of the last one measured with the analyzer are converted into a path difference (nm).

Alternatively, the Senarmont compensation method as disclosed in detail in U.S. Pat. No. 5,141,700 (Sze) in Columns 5 and 6 starting at Line 23 in Column 5 could be used to obtain the same birefringence data. Fundamentally, the birefringence method calls for the measurement of the path difference between two waves of polarized light associated with a birefringent filament. This path difference divided by the filament diameter (in micrometers) is the definition of birefringence.

EXAMPLES

Comparative Example A

Nylon 6,6 polymer flake (38 relative viscosity) commercially available from DuPont, Canada was solid phase polymerized with dry nitrogen, substantially free of oxygen, to increase the polymer molecular weight. The polymer was conveyed to a screw-melter and extruded. The molten polymer was then introduced to a filament spinning pack and filtered prior to extrusion to a spinning die (or spinneret) having 34 capillaries. This spinneret allowed the formation of 34 individual filaments. These filaments were quenched in air using the cross-flow quench and coupled spin-draw apparatus shown in FIG. 1. The filaments were converged into a yarn with application of a conventional finish lubricant, and forwarded by a feed roll assembly 70 having a roll surface speed of 651 meters per minute and a roll surface temperature of 50° C. The yarn was then fed to a first draw roll pair 80, having a roll surface temperature of 170° C. and a surface speed of 2.6 times the feed roll speed. Then the yarn was fed to a second draw roll pair 100, with a roll surface temperature of 215° C., which provided an overall speed of 2800 meters per minute, equal to a draw ratio of 4.3 times the feed roll speed. Hot tube 90 was not used in this comparative example. The 34-filament yarn was relaxed at puller rolls 110 and 120 in speed by 7.1% and wound up into a yarn package 140 at a speed of 2587 meters per minute. The resulting 110-denier yarn (34 filaments) had a tenacity of 8.8 grams per denier (7.8 cN/dtex), an elongation-to-break of 18%, and hot air shrinkage of 6.6%. The measured yarn relative viscosity (RV) was 70.

Example 1

The same nylon 6,6 polymer flake, as used in Comparative Example A, was melt extruded and processed in the same manner as Comparative Example A prior to entering the spinning pack 400 shown in FIG. 4. The polymer was extruded through a spinneret to form 34 filaments. The freshly extruded filaments were quenched in air using a pneumatic quench apparatus as shown in FIG. 3 and the coupled multiple stage draw roll assembly shown in FIG. 4. Hot tube 475 (FIG. 4) was not used.

Referring to FIG. 3, the quench screen 345 was 4.0 inches (10.2 cm) in diameter $D_1$ with a quench screen length B of 6.5 inches (16.5 cm); a quench delay height A of 6.6 inches (16.8 cm); a quench connecting tube 355 height $C_1$ of 5.0 inches (12.7 cm); a quench connecting tube diameter $D_2$ of 1.5 inches (3.8 cm); a connecting taper 325 height ($C_2$) of 4.8 inches (12.2 cm); and a tube 330 height ($C_3$) of 15 inches (38 cm).

Obtained from Equation 2, the ratio of air velocity to feed roll speed 465 (FIG. 4) was 1.02 feet per minute (31 cm/minute).

$$\text{Ratio}=(\text{Air velocity at tube } C_3 \text{ exit})/(\text{Feed roll } \mathbf{465} \text{ surface speed}) \quad \text{Eq. 2}$$

Where the air velocity at tube 330 (FIG. 3) exit is equal to the measured volumetric air flow rate divided by tube 330 cross-sectional area or $\square D_3)^2/4$. This ratio is then corrected for the decrease in air density due to the bulk air temperature rise in the pneumatic quench unit.

Finish was applied at 450 (in FIG. 4) and the filaments were converged into a yarn using a pigtail guide 455 located downstream of finish roll 450. The yarn was forwarded by a feed roll assembly 465 to the first draw roll pair 470. The feed roll assembly 465 had a surface speed of 1087 meters per minute and a surface temperature of 50° C. The first draw roll pair 470 had a roll surface temperature of 170° C. The surface speed was 3.2 times the feed roll speed.

The filaments were then passed to a second draw roll pair 480 bypassing the hot tube 475, not used for this example. Draw roll 480, with a surface temperature of 212° C. and surface speed of 5000 meters per minute, provided an overall draw ratio of 4.6. Overall draw ratio was calculated by dividing draw roll 480 surface speed by the feed roll 465 surface speed. The 34-filament yarn was relaxed in speed at 485 by 7.4% in speed and wound up at a speed of 4600 meters per minute. The resulting 110-denier yarn had a tenacity of 9.1 grams per denier (8.0 cN/dtex), an elongation-to-break of 20.6% and hot air shrinkage of 6.7%. The measured yarn RV was 70.

Example 2

Using the spinning machine arrangement of FIG. 4, the same nylon 6,6 polymer flake used in Comparative Example A was processed, melt extruded and conveyed to the spin pack 410 for extrusion through a spinneret to form 34 filaments. The freshly extruded filaments 420 were quenched in air according to the present invention using the pneumatic quench apparatus shown in FIG. 3. The coupled multiple stage draw roll and hot tube 475 process shown in FIG. 4 was used. Referring to FIG. 3, the quench screen 345 was 4.0 inches in diameter (10.2 cm) with a quench length B of 8.1 inches (20.6 cm); a quench delay height A of 6.6 inches (16.8 cm); a quench connecting tube 355 had a height $C_1$ of 5.0 inches (12.7 cm); a connecting tube 355 diameter $D_2$ of 1.5 inches (3.8 cm); a connecting taper 325 had a height $C_2$ of 4.8 inches (12.2 cm); the quench tube 330 had a tube height $C_3$ of 15 inches (38 cm); and the ratio of air velocity to feed roll assembly speed was 1.05. The filaments were converged into a yarn at 455 with the application of a finish lubricant at 450. The yarn 460 was forwarded by feed roll assembly 465 to a first draw roll pair 470. The feed roll assembly 465 had a surface speed of 1064 meters per minute and a roll surface temperature of 50° C. The first draw roll pair 470 had a roll surface at ambient temperature and a roll surface speed of 2.7 times the feed roll speed.

The filaments were then contacted with a hot tube 475, identical to that hot tube disclosed in U.S. Pat. No. 4,880,961. The yarn was spirally advanced in frictional contact with the hot tube taking one and one-half wrapped around the internally heated hot tube. The surface temperature of the draw assist element hot tube 475 was 181° C. Next the yarn was advanced to a second draw roll pair 480 having a roll surface temperature of 215° C. The overall draw ratio was 4.7 times the feed roll 465 surface speed with second draw roll assembly 480 having a surface speed at 5000 meters per minute. The 34 filament yarn was relaxed in speed by 7.0% at the relaxation roll assembly 485 and wound up into a yarn package 495 at a speed of 4615 meters per minute. The drawn 110 denier (122 dtex—34 filament) yarn had a tenacity of 9.8 grams per denier (8.6 cN/dtex), an elongation-to-break of 16.3% and hot air shrinkage of 7.3%. The measured yarn formic acid RV was 70.

Example 3

A 38 RV nylon 6,6 polymer flake containing 1% by weight of the anatase form of titanium dioxide (HOMBITAN® LO-CR-S-M, Sachtleben Chemie GmbH, Duisburg, Germany) was melt extruded and processed in the same manner as Example 2 using the coupled extrusion and drawing apparatus shown in FIG. 4. An identical spinning pack and spinneret was used to form 34 filaments. The freshly extruded filaments were quenched in air using the pneumatic quench apparatus shown in FIG. 3. The measurements of the pneumatic quench apparatus were identical to those of Example 2. The ratio of air velocity in tube 330 (FIG. 3) to the feed roll assembly 465 speed was 1.1. As before, the filaments were converged by a guide 455 into a yarn with application of a finish lubricant at 450. The feed roll assembly 465 forwarded the yarn to a first draw roll pair 470. The feed roll 465 had a surface speed of 1087 meters per minute and a roll surface temperature of 50° C. The first draw roll pair 470 had a roll surface at ambient temperature and a surface speed of 2.7 times the feed roll speed. The yarn was forwarded to a hot tube as in Example 2. The yarn was spirally advanced in frictional contact with the hot tube taking one and one-half wraps around the internally heated hot tube. The surface temperature of the draw assist element 475 was 181° C. Next the yarn was advanced to a second draw roll pair 480 with a surface speed of 5000 meters per minute and a roll surface temperature of 215° C., providing an overall draw ratio of 4.6 times the feed roll speed. The 34 filament yarn was relaxed in speed by 6.5% using relaxation roll assembly 485 and wound up at a speed of 4645 meters per minute to form package 495. The resulting 110 denier (122 dtex—34 filaments) yarn had a tenacity of 8.7 grams per denier (7.7 cN/dtex), an elongation-to-break of 17.6% and hot air shrinkage of 7.1%. The measured yarn formic acid RV was 78.

Comparative Example B

A 38 RV nylon 6,6 polymer flake identical to that used in Example 1 was melt extruded using the coupled spinning and multi-stage drawing apparatus of FIG. 1. The spin pack 20 contained a spinneret with 34 capillaries, and 34 filaments were spun. Each filament was 6 denier (6.6 dtex) in fineness after the multi-stage drawing. The filaments (30 in FIG. 1) were cooled and solidified using a cross flow of quench air 40 according to the known process of the prior art. The filaments were converged into a yarn with application of a finish lubricant at 50. The yarn 60 was forwarded to a first draw roll pair 80 by a feed roll assembly 70 having a peripheral speed of 560 meters per minute and a roll surface temperature of 50° C. The first draw roll pair 80 had a roll surface temperature of 170° C. and a surface speed of 3.0 times the feed roll speed. No hot tube 90 was used. The yarn was then fed to a second draw roll pair 100 having a roll surface temperature of 215° C., which provided an overall draw ratio of 5 times the feed roll speed or 2800 meters per minute. The 34 filament yarn was relaxed in speed by 8.0% and wound up at a speed of 2562 meters per minute. The drawn 210 denier (233 dtex) yarn had a tenacity of 9.4 grams per denier (8.3 cN/dtex), an elongation-to-break of 17.5% and hot air shrinkage of 6.7%. The measured yarn formic acid RV was 70.

Example 4

Using the pneumatically quenched coupled spinning and drawing apparatus of FIG. 4 (without the hot tube 475), a nylon 6,6 polymer was processed identically to Comparative Example A prior to the spinning pack and melt extruded through a spinneret to form 34 filaments. The freshly extruded filaments were quenched in air using a pneumatic quench apparatus of the invention as shown in FIG. 3 and the coupled multiple stage draw roll assembly as shown in FIG. 4.

Referring to FIG. 3, the quench screen 345 was 4.0 inches in diameter (10.2 cm) with a quench height B of 6.5 inches (16.5 cm); a quench delay height A of 6.6 inches (16.8 cm); a quench connecting tube 355 had a height $C_1$ of 12.5 inches (31.7 cm); a connecting tube had a diameter $D_2$ of 1.5 inches (3.8 cm); a connecting taper 325 had a height $C_2$ of 4.8 inches (12.2 cm) and quench tube 330 had a height $C_3$ of 15 inches (38 cm). The ratio of air velocity in quench tube 330 to feed roll assembly speed 465 (in FIG. 4) was 0.87.

The filaments 420 were converged into a yarn at 455 with application of a finish lubricant at 450. The yarn 460 was forwarded by a feed roll 465 to a first draw roll pair 470. The feed roll had a peripheral speed of 1042 meters per minute and a roll surface temperature of 50° C. The first draw roll pair 470 had a roll surface temperature of 170° C. and a surface speed of 2.8 times the feed roll speed. The yarn was then fed to a second draw roll pair 480 having a roll surface temperature of 220° C., by-passing the hot tube 475. The second drawing roll 480 provided an overall draw ratio of 4.8 times the feed roll speed, or 5000 meters per minute. The 34-filament yarn was relaxed in speed by 7.0% and wound up by a relaxation roll assembly 485 at a speed of 4620 meters per minute. After drawing, the 210 denier (233 dtex—34 filament) yarn had a tenacity of 10.0 grams per denier (8.8 cN/dtex), an elongation-to-break of 17.9% and hot air shrinkage of 6.8%. The measured yarn formic acid RV was 70.

Example 5

Using the pneumatically quenched coupled spinning and drawing apparatus of FIG. 4 with the hot tube (draw assist element 475), a nylon 6,6 polymer was processed identically to Comparative Example A prior to the spinning pack and melt extruded through a spinneret to form 34 filaments. The freshly extruded filaments were quenched in air using a pneumatic quench apparatus of the invention as shown in FIG. 3 and the coupled multiple stage draw roll assembly as shown in FIG. 4.

Referring to FIG. 3, the quench screen 345 was 4.0 inches in diameter (10.2 cm) with a quench height B of 6.5 inches (16.5 cm); a quench delay height A of 6.6 inches (16.8 cm); a quench connecting tube 355 had a height $C_1$ of 12.5 inches (31.7 cm); a connecting tube had a diameter $D_2$ of 1.5 inches (3.8 cm); a connecting taper 325 had a height $C_2$ of 4.8 inches (12.2 cm) and quench tube 330 had a height $C_3$ of 15 inches (38 cm). The ratio of air velocity in quench tube 330 to feed roll assembly speed 465 (in FIG. 4.) was 1.12.

The filaments were converged into a yarn at guide 455, with prior application of a finish lubricant at 450. The yarn was forwarded by a feed roll assembly 465 to a first draw roll pair 470 and then to a draw assist element 475. The feed roll assembly 465 had a surface speed of 1087 meters per minute and a roll surface temperature of 50° C. The first draw roll pair 470 had a roll surface at ambient temperature and a surface speed of 2.8 times the feed roll speed. The yarn was spirally advanced in frictional contact with the draw assist element 475 taking one and one-half wraps around the internally heated hot tube. The surface temperature of the draw assist element 475 was 181° C.

Next the yarn was advanced to a second draw roll pair 480 having a roll surface temperature of 215° C., providing an overall draw ratio of at least 5 times the feed roll speed, or about 5000 meters per minute. The 34-filament yarn was relaxed in speed by 6.5% with relaxation roll assembly 485 and wound up by at a speed of 4630 meters per minute into yarn package 495. After drawing, the resulting 210 denier (233 dtex—34 filament) yarn had a tenacity of 9.9 grams per denier (8.7 cN/dtex), an elongation-to-break of 18% and hot air shrinkage of 7.9%. The measured yarn formic acid RV was 70.

Comparative Example C

A 60 RV nylon 6,6 polymer flake (source: E. I. du Pont de Nemours, Waynesboro, Va.) containing about 0.1% copper iodide was dried and melt extruded as in Comparative Example A. A melt extrusion and coupled multi-stage drawing assembly using a cross-flow quench system (230 in FIG. 2) of the prior art was used in this comparative example. The spinning die (contained in spin pack 210) had 34 capillaries. A 34 filament multi-filament yarn was prepared. The yarn was oiled at 240 and converged into a yarn and forwarded by feed roll 260 having surface temperature was 60° C. The first stage draw roll pair 270 surface temperature was 170° C. The second stage draw roll pair 275 surface temperature was 215° C. The optional draw roll assembly 280 in FIG. 2 was not used. The yarn spinning speed was determined by the surface speed of roll assembly 275. A 6 nominal denier (6.7 dtex) per filament yarn was prepared at three different spinning speeds, three maximum draw ratios (roll 275 speed divided by roll 260 speed) and associated percent relaxation in spinning speed provided by roll assembly 285 and the winder 295. The measured yarn formic acid RV was 60. The tenacity and elongation-to-break for each spinning speed trial are given in Table 1.

These values in Table 1 correspond to the limits of the prior art cross flow quench. Well-illustrated is the decrease in maximum draw ratio available without fundamental process interruptions, e.g., high levels of broken filaments as spinning speed was increased. Since a higher draw ratio could not be used, the achievable yarn tenacity fell as the spinning speed was increased.

TABLE 1

| Comparative Example C | | | |
|---|---|---|---|
| Spinning Speed (surface speed of roll 275 in FIG. 2. meters/minute) | 2660 | 3660 | 4655 |
| Draw Ratio (Speed 275/speed 260) | 5.5 | 4.5 | 2.5 |
| Tenacity in grams/denier (cN/dtex) | 8.9 (7.8) | 8.5 (7.5) | 6.6 (5.8) |
| Elongation-to-break, % | 15.0 | 14.9 | 19.6 |
| Relaxation to roll 285, % | 6.6 | 5.2 | 0.1 |

Example 6

A 60 RV nylon 6,6 polymer flake (source: E. I. du Pont de Nemours, Waynesboro, Va.) containing about 0.1% copper iodide was dried and melt extruded as in Comparative Example A. The melt extrusion and coupled multi-stage drawing assembly of FIG. 5 using the pneumatic quench system illustrated by FIG. 3 was used to spin and draw a yarn of 34 filaments. The spinning die contained in spin pack 510 had 34 capillaries. The pneumatic quench assembly (FIG. 3) with dimensions given in Table 2 was used. The filaments after pneumatic quenching were oiled at 530 and converged into the multi-filament yarn at pigtail guide 535. The yarn was passed through a two-stage draw roll assembly by a feed roll assembly 540 having a surface temperature of 60° C. The first stage draw roll 545 surface temperature was 170° C. and the second stage draw 550 roll surface temperature was 215° C. A 210-denier (233 dtex—34 filaments) yarn was prepared using 3 different spinning speeds. The overall draw ratio was equal to the speed of roll 550 divided by the speed of roll 540 and percent relaxation in speed at the winder are given in Table 2. The measured yarn formic acid RV was 60.

The tenacity and elongation-to-break for each spinning speed trial are presented in Table 2. As in the Comparative Example C, draw ratio is the maximum draw ratio permitted by the process continuity, e.g. excessive broken filaments.

TABLE 2

| Example 6 | | | |
|---|---|---|---|
| Spinning Speed (roll assembly 550 in FIG. 5.) | 2660 meters per minute | 3660 meters per minute | 4660 meters per minute |
| A Quench Delay Height | 20.3 cm | 20.3 cm | 20.3 cm |
| B Quench Screen Height | 15.2 cm | 15.2 cm | 15.2 cm |
| $C_1$, Connecting Tube Height | 20.3 cm | 20.3 cm | 20.3 cm |
| $C_2$, Connecting Taper Height | 12.2 cm | 12.2 cm | 12.2 cm |
| $C_3$, Tube Height | 38.1 cm | 38.1 cm | 38.1 cm |
| $D_1$ Quench Screen diameter | 10.2 cm | 10.2 cm | 10.2 cm |
| $D_3$ Tube diameter of 1.5 inch (3.8 cm) | 3.8 cm | 3.8 cm | 3.8 cm |
| Ratio of Air velocity to feed roll (540) speed Equation 1. | 0.97 | 1.1 | 0.88 |
| Draw Ratio Roll 550 speed/roll 540 speed | 5.8 | 5.5 | 4.7 |
| Tenacity grams/denier (cN/dtex) | 9.5(8.4) | 9.3(8.2) | 8.6(7.6) |
| Elongation-to-break, % | 16.2 | 15.2 | 17.3 |
| Relaxation, % change in speed of roll 560 from roll 550 | 6.4 | 5.5 | 0.9 |

Example 6, the pneumatically quenched coupled spin-draw system for making on a highly drawn yarn, dramatically demonstrates the effect of pneumatic quench spinning process over the cross-flow quench prior art Comparative Example C. At the two lowest spinning speeds used, 2660 and 3660 meters per minute, the yarn tenacity and elongation-to-break for cross-flow quench (Table 1) and pneumatic quench (Table 2) are different. This difference is due to the pneumatically quenched yarns being drawn to a higher draw ratio without filament spinning breaks, i.e. loss of process continuity.

The cross-flow quenched yarn (Table 1) could be drawn to a lesser degree at 3660 meters per minute, because filament breaks interrupted the spinning continuity. At the highest spinning speeds compared, 4660 meters per minute (see Tables 1 and 2), a much higher draw ratio without filaments breaks could be used with pneumatic quenching. This draw ratio allowed a high tenacity yarn to be prepared in comparison to a yarn spun using a cross-flow quench assembly.

Comparative Example D

Figure 2:
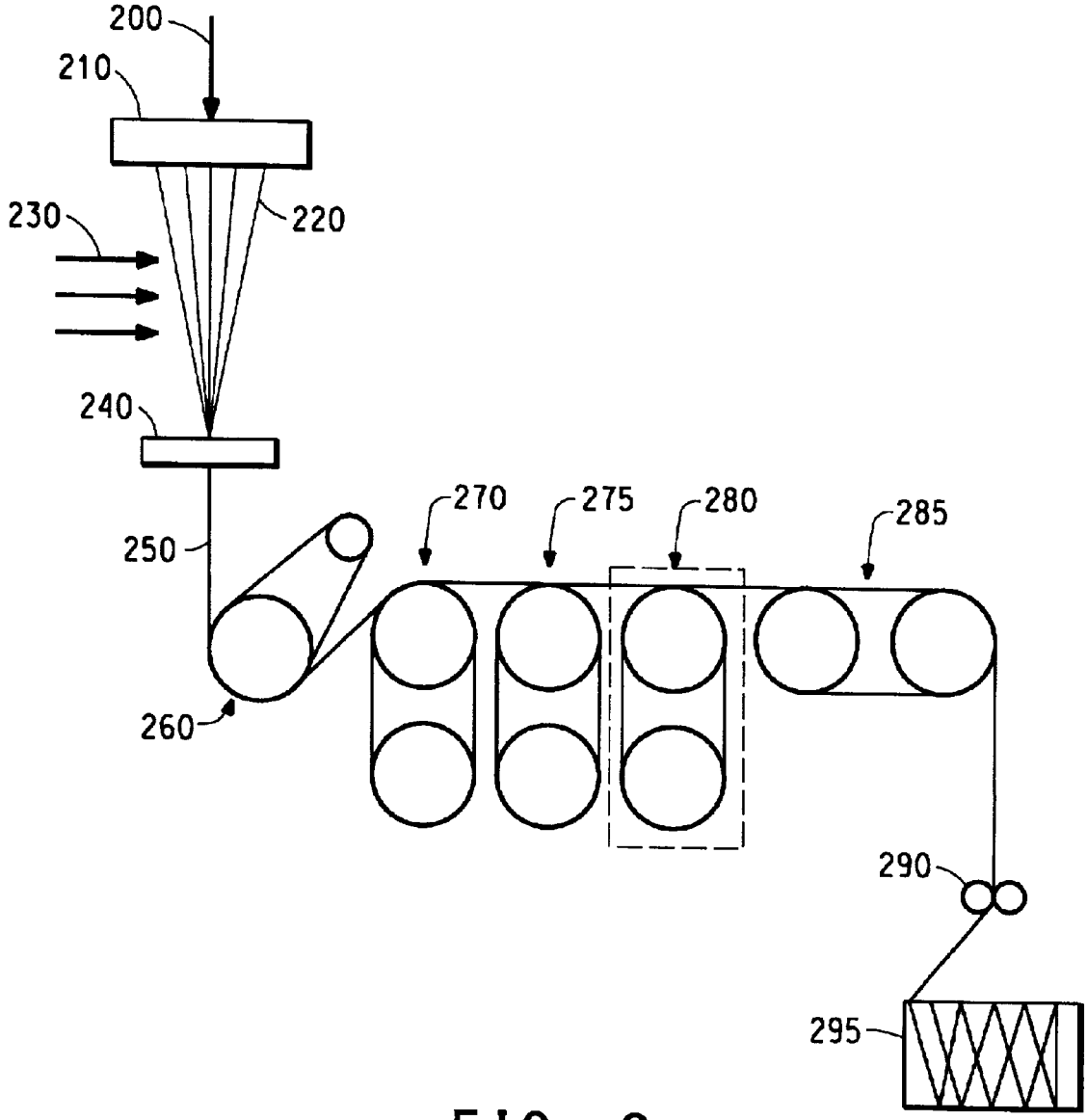
FIG. 2 (PRIOR ART)
FIG. 2 is a schematic cross-sectional view of a second prior art filament quenching and coupled spin-draw apparatus which uses a roll instead of a hot tube for drawing.

A 60 RV nylon 6,6 polymer flake from E. I. du Pont de Nemours and Co., Waynesboro, Virginia containing about 0.1% copper iodide antioxidant was dried and melt extruded using a spinning machine as shown in FIG. 2 employing a prior art cross-flow quench system. The spinning pack 210 contained a spinneret with 34 holes. The feed roll 260 surface temperature was ambient. The first stage draw roll 270 and second stage draw roll 275 were not used. The yarn was collected from the feed roll assembly 260 immediately after forwarding. Four yarns were prepared using 4 different feed roll spinning speeds and 4 different mass flow throughputs per spinning orifice per minute. These provisions maintained the filament denier constant at the feed roll at all speeds and throughput combinations. The yarns were not drawn. The measured yarn formic acid RV as spun was 60. Birefringence measurements were made on the yarn samples.

Example 7

The same polymer as Comparative Example D was extruded to a coupled spin-draw filament spinning machine of the invention as shown in FIG. 5. Except for the changing the quench means from cross-flow to pneumatically quenched (as in FIG. 3), the experimental conditions of Comparative Example D were used. The pneumatically quenched 34 filament yarns were collected directly after the feed roll assembly 540. The birefringence of the yarns produced under the same four conditions of feed roll speed and mass throughput per spinning orifice used for Comparative Example D were measured. The results are given in Table 3.

The results given in Table 3 comparing invention Example 7 with Comparative Example D clearly illustrate the advantage of pneumatic filament quenching over cross-flow quenching systems of the prior art. For Comparative Example D, the filament birefringence measured at the feed roll is higher for each speed and polymer throughput than that birefringence measured for pneumatic quenching under identical conditions. The birefringence of the pneumatically quenched yarn is indicative of a less oriented polymer i.e., a polymer, which can be drawn further and become more highly oriented. A drawn yarn of a more highly oriented polymer will have higher tenacity and lower elongation to break than a drawn yarn of less oriented polymer. The pneumatically quenched filaments collected at the feed roll have a consistently lower birefringence than cross-flow quenched filaments. In fact, the pneumatically quenched filaments collected highest spin speed have a birefringence only about 18% greater than the birefringence of the cross-flow quenched yarn collected at the lowest spin speed. Since pneumatically quenched filaments are less oriented in the quench process, even at higher spin speeds, a higher productivity spinning and mechanical drawing process is possible using pneumatic quench.

TABLE 3

| Throughput per spinneret orifice (grams/min.) | Feed Roll Speed (meters per minute) | Comp. Example D Birefringence for Cross-flow quench | Example 7 Birefringence for Pneumatic quench |
|---|---|---|---|
| 1.69 | 532 | 0.00975 | 0.00211 |
| 2.32 | 732 | 0.01323 | 0.00448 |
| 3.05 | 960 | 0.01688 | 0.01027 |
| 3.81 | 1200 | 0.01982 | 0.01152 |

Comparative Example E

A 60 RV nylon 6,6 polymer flake from E. I. du Pont de Nemours and Co., Waynesboro, Va. containing about 0.1% copper iodide antioxidant was dried and melt extruded as in the previous examples to a spinning machine with two coupled draw stages as shown in FIG. 2. The prior art cross-flow quench means was used. The spinning pack contained a spinneret die with 34 holes and a 34 filament yarn was prepared. The yarn 250 was forwarded by a feed roll 260 with a surface temperature of 60° C. The first stage draw roll 270 surface temperature was 170° C. and the second stage draw roll 275 surface temperature was 215° C. A 210 nominal denier (233 dtex—34 filaments) yarn was prepared using 3 different spinning speeds (the speed of draw roll assembly 275) and overall draw ratios (the speed ratio of roll 275 divided by the feed roll 260). The measured yarn formic acid RV was 60. The yarn tenacity for each spinning speed trial is given in the Table 4.

Comparative Example F

The same as in 60 RV nylon 6,6 polymer flake as in Comparative Example E was dried and melt extruded to a spinning machine with three coupled draw stages as shown in FIG. 2. The same prior art cross-flow quench system was used. The feed roll 260 surface temperature was 60° C. The first draw roll 270, second draw roll 275, and third stage draw roll 280 surface temperatures were 170° C., 230° C., and 230° C., respectively. The spinning die contained in spin pack 210 had 34 holes and a 34 filament yarn (210 denier or 233 dtex—34 filaments) was prepared using three different spinning speeds (the speed of the highest speed draw roll 280) and overall draw ratios (the speed ratio of roll 280 divided by feed roll 260). The measured yarn formic acid RV was 60. The yarn tenacity for each spinning speed trial is given in Table 4.

TABLE 4

| | Spinning Speed, 2660 meters per minute | Tenacity Grams per denier (cN/dtex) | Spinning Speed, 3660 meters per minute | Tenacity Grams per denier (cN/dtex) | Spinning Speed, 4660 meters per minute | Tenacity Grams per denier (cN/dtex) |
|---|---|---|---|---|---|---|
| Comp. Ex. E cross-flow; 2 stage draw | Draw ratio = 5.5 | 9.5 (8.4) | Draw ratio = 4.3 | 8.6 (7.6) | Draw ratio = 2.6 | 6.0 (5.3) |
| Comp. Ex. F cross-flow; 3 stage draw | Draw ratio = 5.5 | 9.5 (8.4) | Draw ratio = 4.7 | 8.8 (7.8) | Draw ratio = 3.0 | 7.7 (6.8) |

Example 8

In this example of the invention the identical 60 RV nylon 6,6 polymer flake as used in Comparative Examples E and F was dried and melt extruded to the coupled spin-draw machine illustrated in FIG. 5 and using the pneumatic quench system illustrated in FIG. 3. Only two drawing stages were used, roll assembly 555 was by-passed. The spinning die contained in spin pack 510 had 34 holes. The filaments 515 were oiled at fiber finish roll 530 and converged into a yarn of 34 filaments at pigtail guide 535. This yarn was forwarded by feed roll 540 operating with a surface temperature of 60° C. to the coupled pair of drawing stages. The first stage draw roll 545 and second stage draw roll 550 surface temperatures were 170° C. and 215° C., respectively. Three 210 denier (233 dtex—34 filaments) yarns were prepared at three different spinning speeds (spinning speed was the speed of roll assembly 550) and overall draw ratios (overall draw ratio was the speed of roll 550 divided by the speed of roll 540). The yarn was relaxed in speed by an amount equal to the difference in speeds of roll assemblies 560 and 550 divided by the speed of roll assembly 550. The measured yarn formic acid RV was 60.

The yarn properties for each spinning speed trial are given in Table 5.

Example 9

Example 8 was repeated with the identical polymer and spinning die using the apparatus of FIG. 5 and three stages of drawing rolls (roll assembly 555 was included). The first stage draw roll 545, second stage draw roll 550 and third stage draw roll 555 surface temperatures were 170° C., 230° C. and 230° C., respectively. Three 210 denier (233 dtex—34 filaments) yarns were prepared at three different spinning speeds (spinning speed was the speed of roll assembly 555) and overall draw ratios (overall draw ratio was the speed of roll 555 divided by the speed of roll 540). The yarn was relaxed in speed by an amount equal to the difference in speeds of roll assemblies 560 and 555 divided by the speed of roll assembly 555. The measured yarn formic acid RV was 60.

The yarn properties for each spinning speed trial are given in Table 5.

TABLE 5

| | Spinning Speed, 2660 meters per minute | Tenacity Grams per denier (cN/dtex) | Spinning Speed, 3660 meters per minute | Tenacity Grams per denier (cN/dtex) | Spinning Speed, 4660 meters per minute | Tenacity Grams per denier (cN/dtex) |
|---|---|---|---|---|---|---|
| Example 8 pneumatic quench; 2 stage draw | Draw ratio = 6.0 | 9.6 (8.5) | Draw ratio = 5.2 | 9.2 (8.1) | Draw ratio = 4.8 | 8.3 (7.3) |
| Example 9 pneumatic quench; 3 stage draw | Draw ratio = 6.4 | 10.7 (9.4) | Draw ratio = 5.8 | 9.9 (8.7) | Draw ratio = 5.2 | 9.3 (8.2) |

The data of Tables 4 and 5 show the superior productivity achievable with the pneumatic quench system and coupled spin-draw means versus a prior art cross-flow quench system with coupled spin-draw processes. As a result, higher overall spinning speeds can be used with overall draw ratios not possible due to increasing numbers of broken filaments using cross-flow quenching, regardless of the number of stages for drawing, to prepare high tenacity polyamide filament yarns.

Example 10

The coupled spin-draw apparatus of FIG. 4 was used in this example with two stages of draw rolls and hot tube 475 was not used. A 70 RV nylon 6,6 polymer from DuPont Canada was melt extruded into spin pack 410 which contained a 34 capillary spinneret plate. The 34 filaments were quenched pneumatically with the apparatus shown schematically in FIG. 3. The filaments were oiled at 450 and converged into a 34 filament yarn at pigtail guide 455. This yarn was forwarded by feed roll assembly 465 to two stages of coupled drawing using draw roll assemblies 470 and 480 and bypassing the hot tube 475. The spinning speed (the speed of the highest speed draw roll assembly 480) was varied as shown in Table 6 from 2660 meters per minute to 6000 meters per minute. The feed roll assembly 465, the first stage draw roll 470 and the second stage draw roll 480 temperatures were 50° C., 170° C. and 215° C., respectively. The draw ratio was the ratio of surface speeds of roll assembly 480 to that of roll assembly 465. The relaxation amount was given by the difference in surface speed between roll assemblies 480 and 485 divided by the surface speed of roll assembly 480. The trials at 5000 meters per minute and 6000 meters per minute were performed with a reduced polymer throughput in order to provide 110 denier (122 dtex—34 filaments) yarns in lieu of 210 denier (233 dtex—34 filaments) yarns provided at the lower spinning speeds. The yarn relaxation (speed reduction) was provided by roll assembly 485 prior to winding up into yarn packages 495. The exception to yarn package winding were yarns spun at 6000 meters per minute. These yarns were not wound up but aspirated into a yarn string up device known in the art.

Table 6 summarizes the properties of the five pneumatically quenched and drawn yarn samples prepared.

In comparative experiments performed with the identical polymer used in invention Example 10, drawn yarns were prepared using a cross flow quenching means of the prior art with a coupled two stage draw roll assembly shown in FIG. 1, but bypassing the hot tube 90. The spinning die had 34 holes as before. The filaments were oiled at 50 and converged into a 34 filament yarn. This yarn was forwarded by feed roll assembly 70 to two stages of coupled drawing using draw roll assemblies 80 and 100 and bypassing the hot tube 90. The spinning speed (the speed of the highest speed draw roll assembly 100) was varied as shown in Table 6 from 2660 meters per minute to 4200 meters per minute. The draw ratio was the surface speed ratio of draw roll assembly 100 to that of feed roll assembly 70. The feed roll assembly 70, the first stage draw roll 80 and the second stage draw roll 100 temperatures were 50° C., 170° C. and 215° C., respectively. The relaxation amount is given by the surface speed difference between roll assemblies 120 and 100 divided by the speed of roll assembly 100. A 210 denier (233 dtex) yarn was wound into a yarn package 140 after relaxation in speed using roll assembly 120.

Table 6 summarizes the properties of the three cross flow quenched and drawn yarn samples prepared.

TABLE 6

| Quench air means | Spinning speed (meters per minute) | Ratio of pneumatic air velocity to feed roll speed (Equation 1) | Yarn denier after drawing (34 filaments) | Tenacity Grams per denier (cN/dtex) and Per cent elongation at break | draw ratio (Maximum) | Relaxation to let down roll 120 |
|---|---|---|---|---|---|---|
| Cross-flow | 2660 | . . . | 210 | 10.6(9.3) 15.1% | 5.6 | 6.5% |
| Cross-flow | 3660 | . . . | 210 | 9.6(8.5) 17.5% | 4.8 | 3.3% |

TABLE 6-continued

| Quench air means | Spinning speed (meters per minute) | Ratio of pneumatic air velocity to feed roll speed (Equation 1) | Yarn denier after drawing (34 filaments) | Tenacity Grams per denier (cN/dtex) and Per cent elongation at break | draw ratio (Maximum) | Relaxation to let down roll 120 |
|---|---|---|---|---|---|---|
| Cross-flow | 4200 | . . . | 210 | 8.8(7.8) 19.9% | 3.6 | 2.6% |
| Pneumatic | 2660* | 1.20 | 210 | 10.4(9.2) 17.3% | 6.0 | 6.5% |
| Pneumatic | 3660* | 1.00 | 210 | 11.2(9.9) 15.0% | 6.0 | 4.4% |
| Pneumatic | 4200* | 1.05 | 210 | 10.6(9.4) 16.3% | 5.6 | 2.6% |
| Pneumatic | 5000** | 0.88 | 110 | 10.2(9.0) 12.9% | 5.6 | 3.4 |
| Pneumatic | 6000** | 1.12 | 110 | . . . | 5.6 | . . . |

*Here, the quench screen was 4 inches in diameter $D_1$ (10.2 cm) with a quench screen height B of 6.5 inches (16.5 cm); a quench delay height A of 6 inches (15.2 cm); a quench connecting tube height $C_1$ of 12.5 inches (31.8 cm); a connecting tube diameter $D_3$ of 1.5 inches (3.8 cm), a connecting taper height $C_2$ of 4.8 inches (12.2 cm); and a tube height $C_3$ of 15 inches (38 cm).
**In these two cases, all the above parameters were the same except for the quench connecting tube height $C_1$ of 5 inches (12.7 cm).

These results in Table 6 show that the process of the present invention can be used with spinning speeds of about 6000 meters per minute. The prior art coupled spin-draw process using cross flow quench means failed to provide good spinning continuity do to excessive spin breaks at speeds of only about 4200 meters per minute. At spin speeds of 5000 meters per minute, the pneumatic quench coupled spin-draw process provided a high tenacity (9.0 cN/dtex) yarn using a mechanical draw ratio of only 5.6. The prior art means was able to provide about the same tenacity yarn at a spin speed of 2660 meters per minute but required an overall maximum draw ratio of 6.6. These 233 detex, 34 filament yarns are substantially equivalent and in their balance of properties. However, the coupled spin-draw process of the invention provides this yarn with a productivity improvement of about 88 per cent. This productivity improvement is clearly a commercial advantage and superior to the prior art processes. This Example shows that pneumatic quenching means combined with a coupled multi-stage draw process allows for higher spinning speeds and higher overall draw ratios, while maintaining high yarn tenacity and robust percent elongation-to-break properties of the yarn not achievable using cross flow quench means.

Comparative Example G

In another comparative experiment performed with the identical polymer used in invention Example 10, drawn yarns were prepared using a cross flow quenching means of the prior art with a coupled two stage draw roll assembly shown in FIG. 1.

Here the hot tube 90 was by passed and two stages of coupled draw were used, roll assemblies 80 and 100. The spinning speed (surface speed of roll 100) was 2800 meters per minute and the overall draw ratio (ratio of speeds roll 100 to roll 70) was 4.1. After drawing, the resulting 110 denier (122 dtex—34 filament) yarn had a tenacity of 8.3 grams per denier (7.3 cN/dtex) and an elongation-to-break of 14%. The denier uniformity along the length ("along end") of each yarn sample prepared was 3.7%.

Example 11

In an example of the invention, the identical polymer used in invention Example 10, drawn yarns were prepared using the pneumatic quench means illustrated by FIG. 3 and the coupled two stage draw roll assembly shown in FIG. 4, but without hot tube 475. The quench screen was 4.0 inches (10.1 cm) in diameter $D_1$ with a quench screen B of 6.5 inches (16.5 cm); a quench delay height A of 6.6 inches (16.8 cm); a quench connecting tube height $C_1$ of 12.5 inches (31.8 cm); a connecting tube diameter $D_3$ of 1.5 inches (3.8 cm), a connecting taper height $C_2$ of 4.8 inches (12.2 cm); and a tube height $C_3$ of 15 inches (38 cm). The ratio of air velocity to feed roll assembly speed given by Equation 1 was 1.02. The spinning die had 34 holes. The spinning speed (surface speed of roll assembly 480) was 5000 meters per minute and the overall draw ratio (ratio of the speeds of roll 480 to roll 465) was 4.6. The resulting 110 denier (122 dtex—34 filament) yarn had a tenacity of 8.4 grams per denier (7.4 cN/dtex) and an elongation-to-break of 22%. The denier uniformity along the length ("along end") of each yarn sample prepared was 1.1%.

Comparing Example 11 of the invention with Comparative G illustrates the superior along end denier uniformity achieved using the pneumatic quench means with a coupled spin-draw process operating at high speed. The 122 dtex—34 filament yarns are substantially the same in tenacity, however the highly uniform pneumatically quenched yarn was prepared at a spinning productivity greater than 1.7 times that of the yarn prepared with the prior art quench means.

While the invention was illustrated by reference to specific and preferred embodiments, those skilled in the art will recognize that variations and modifications may be made through routine experimentation and practice of the invention. Thus, the invention is intended not to be limited by the foregoing description, but to be defined by the appended claims and their equivalents.

What is claimed is:

1. A process for producing a polyamide yarn, comprising:

extruding a polymeric melt through a spin pack to form at least one filament;

passing the filament to a pneumatic quench chamber where a quench gas is provided to the filament to cool and solidify the filament, wherein the quench gas is directed to travel in the same direction as the direction of the filament; and passing the at least one filament to a mechanical drawing stage where the filament is drawn and lengthened to produce a yarn.

2. The process as claimed in claim 1, wherein the at least one filament comprises a plurality of filaments, further comprising converging the plurality of filaments into a muitifilament yarn, and passing the yarn to a mechanical drawing stage where the yarn is drawn and lengthened.

3. The process as claimed in claim 1, wherein the at least one filament comprises a single filament per yarn and the yarn is monofilament yarn.

4. The process as claimed in claim 1, wherein the filament is drawn at a draw ratio of about 3 to about 6.

5. The processes claimed in claim 1, wherein the filament passes through the quench chamber at a speed of less than 1500 m/min.

6. The process as claimed in claim 1, wherein the filament passes through at least one drawing stage, and wherein the speed of the filament through the final drawing stage is greater than about 2600 m/min.

7. The process as claimed in claim 6, wherein the filament passes through the final drawing stage at a speed of greater than about 4500 m/min.

8. The process as claimed in claim 1, wherein at a spinning speed of about 2600 to about 5000 meters per minute, the ratio of the velocity of the cooling gas at the exit of the quench chamber to a first roll pulling the filaments is about 0.6 to about 2.0.

9. The process as claimed in claim 1, wherein the filaments are wound into a package at a winding speed reduced from a spinning speed by an amount of about 0.1 per cent to about 7 per cent of the spinning speed.

10. The process as claimed in claim 1, wherein the drawing step composes drawing over a hot tube.

11. The process as claimed in claim 1, wherein the filament has a dtex per filament of between about 2.6 and 9.

12. The process as claimed in claim 1, wherein the birefringence of the filament is between 0.002 and 0.012 before the filament is drawn.

13. The process as claimed in claim 1, wherein the polymeric melt contains colored or delustering particles.

14. The process as claimed in claim 13, wherein the particles are selected from the group consisting of titanium dioxide, zinc sulfide and colored pigments.

15. The process as claimed in claim 13, wherein the polymeric melt contains about 0.01 to about 1.2 percent by weight of the colored or delustering particles.

* * * * *